US010062992B2

(12) United States Patent
Zhao

(10) Patent No.: US 10,062,992 B2
(45) Date of Patent: Aug. 28, 2018

(54) ELECTRICAL CONNECTOR PERFORMING LARGE POWER DELIVERY

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/815,731

(22) Filed: Nov. 17, 2017

(65) Prior Publication Data

US 2018/0138614 A1 May 17, 2018

(30) Foreign Application Priority Data

Nov. 17, 2016 (CN) ..... 2016 2 1233218 U

(51) Int. Cl.

| | |
|---|---|
| ***H01R 24/00*** | (2011.01) |
| ***H01R 12/72*** | (2011.01) |
| ***H01R 13/26*** | (2006.01) |
| ***H01R 13/6597*** | (2011.01) |
| ***H01R 13/52*** | (2006.01) |
| ***H01R 24/60*** | (2011.01) |
| *H01R 12/70* | (2011.01) |
| *H01R 13/74* | (2006.01) |
| *H01R 107/00* | (2006.01) |

(52) U.S. Cl.

CPC ..... *H01R 12/721* (2013.01); *H01R 12/725* (2013.01); *H01R 13/26* (2013.01); *H01R 13/5219* (2013.01); *H01R 13/6597* (2013.01); *H01R 24/60* (2013.01); *H01R 12/7088* (2013.01); *H01R 13/74* (2013.01); *H01R 13/745* (2013.01); *H01R 2107/00* (2013.01)

(58) Field of Classification Search

CPC ..... H01R 23/02; H01R 24/60; H01R 24/62
USPC ..... 439/660
See application file for complete search history.

(56) References Cited

U.S. PATENT DOCUMENTS 8,968,031 B2 * 3/2015 Simmel ..... H01R 13/659 439/108
9,685,739 B2 * 6/2017 Chen ..... H01R 13/6585
(Continued)

FOREIGN PATENT DOCUMENTS

CN 105024197 A 11/2015

*Primary Examiner* — Phuong Dinh
(74) *Attorney, Agent, or Firm* — Wei Te Chung; Ming Chieh Chang

(57) ABSTRACT

An electrical connector includes an insulative hosing having a base and a tongue portion extending forwardly from the base. The tongue portion forms opposite mating surfaces. A plurality of contacts are disposed in the housing and spaced from one another. The contacts include the signal contacts, the power contacts and the grounding contacts. A space/area is formed between the power contact and the ground contact and is configured to be adapted to receive two contacts therein. A conductive bar extending in the front-to-back direction parallel to the contacting sections of the contacts, is embedded within the area and mechanically and electrically connected to the corresponding power contact via at least one linking bar which extends in the transverse direction with an offset manner for hiding the conductive bar from the mating surface in the vertical direction.

6 Claims, 7 Drawing Sheets

(56) References Cited

U.S. PATENT DOCUMENTS

| | | | | |
|---|---|---|---|---|
| 9,806,464 | B1 * | 10/2017 | Wang | H01R 13/6471 |
| 9,837,769 | B2 * | 12/2017 | Yu | H01R 13/652 |
| 2018/0083391 | A1 * | 3/2018 | Peng | H01R 13/658 |

* cited by examiner

ELECTRICAL CONNECTOR PERFORMING LARGE POWER DELIVERY

BACKGROUND OF THE DISCLOSURE

1. Field of the Disclosure

The invention is related to an electrical connector and particularly to the electrical connector delivering the large power.

2. Description of Related Arts

Chinese Patent Application Publication No. 105024197A discloses the electrical connector having the power contact with the large contacting portion while exposing a split narrowed standard contacting area only. Anyhow, the splitting type contacting area may be easily damaged during manufacturing.

It is desired to provide an electrical connector with the enlarged contacting portion of the power contact while exposing the standard contacting area in a reliable manner.

SUMMARY OF THE DISCLOSURE

To achieve the above desire, an electrical connector includes an insulative hosing having a base and a tongue portion extending forwardly from the base along a front-to-back direction. The tongue portion forms opposite mating surfaces in a vertical direction perpendicular to the front-to-back direction. A plurality of contacts are disposed in the housing and spaced from one another along a transverse direction perpendicular to both the front-to-back direction and the vertical direction. Each of the contacts includes a front contacting section, a rear mounting section and a retaining section therebetween. The contacts include the signal contacts, the power contacts and the grounding contacts. A space/area is formed between the power contact and the ground contact and is configured to be adapted to receive two contacts therein. A conductive bar extending in the front-to-back direction parallel to the contacting sections of the contacts, is embedded within the area and mechanically and electrically connected to the corresponding power contact via at least one linking bar which extends in the transverse direction with an offset manner for hiding the conductive bar from the mating surface in the vertical direction.

DETAILED DESCRIPTION OF THE PREFERRED EMBODIMENT

Figure 1:
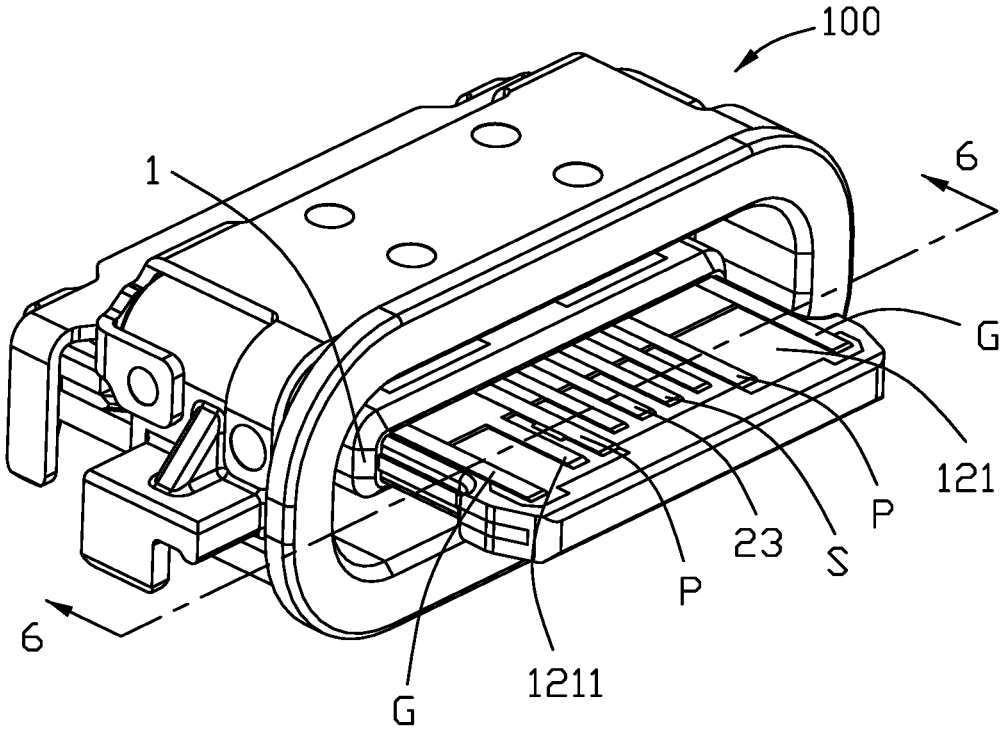
FIG. 1 is a front downward perspective view of an electrical connector according to the invention.
Figure 2:
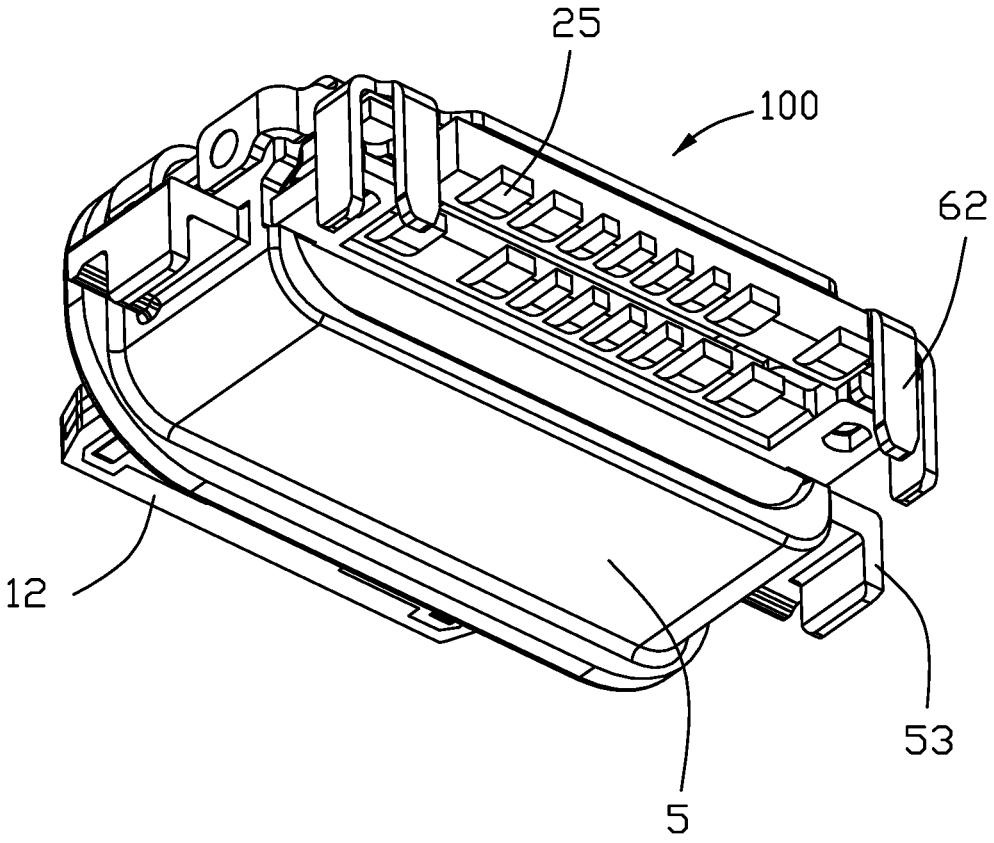
FIG. 2 is a rear upward perspective view of the electrical connector of FIG. 1.
Figure 3:
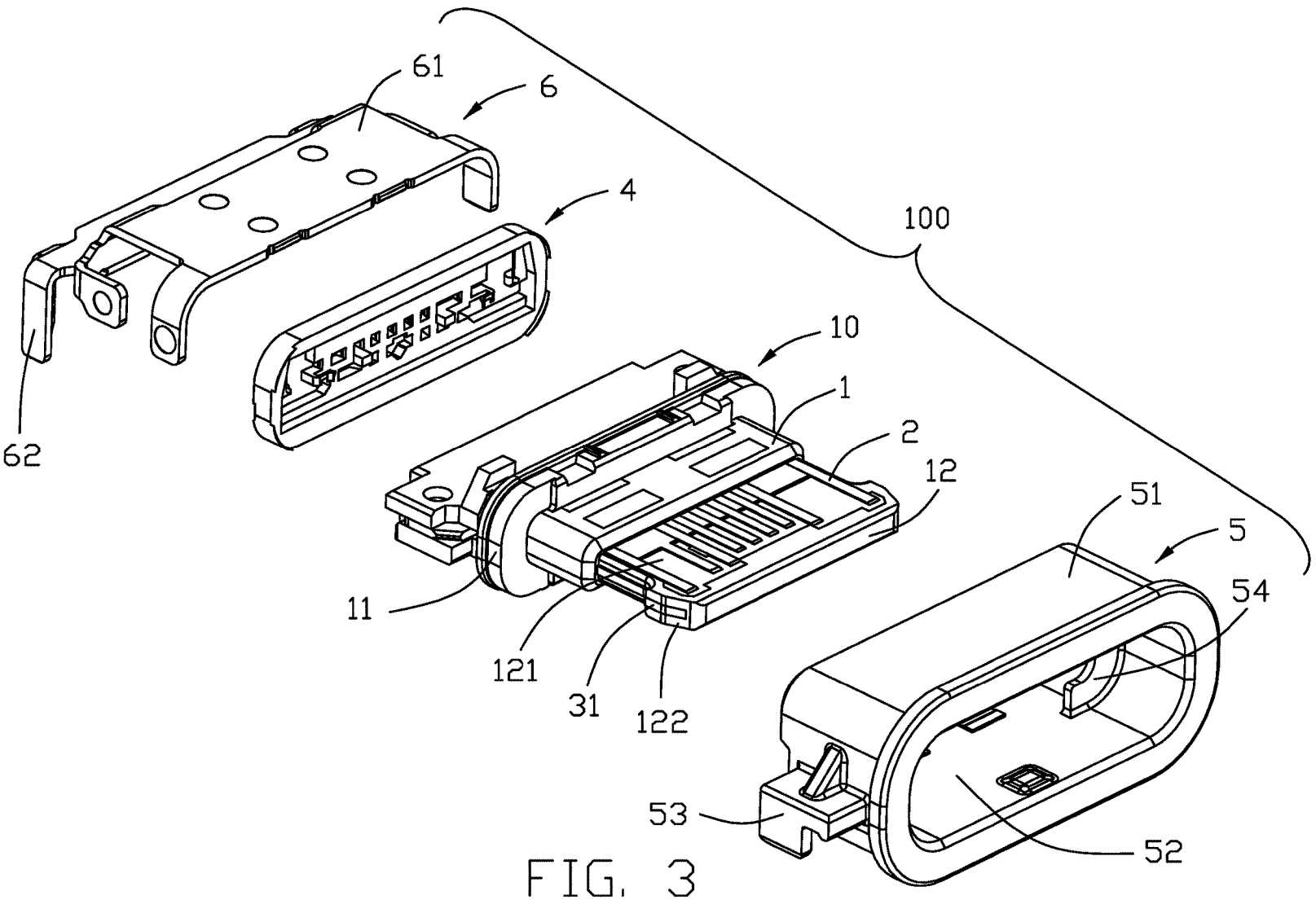
FIG. 3 is a front downward exploded perspective view of the electrical connector of FIG. 1.
Figure 4:
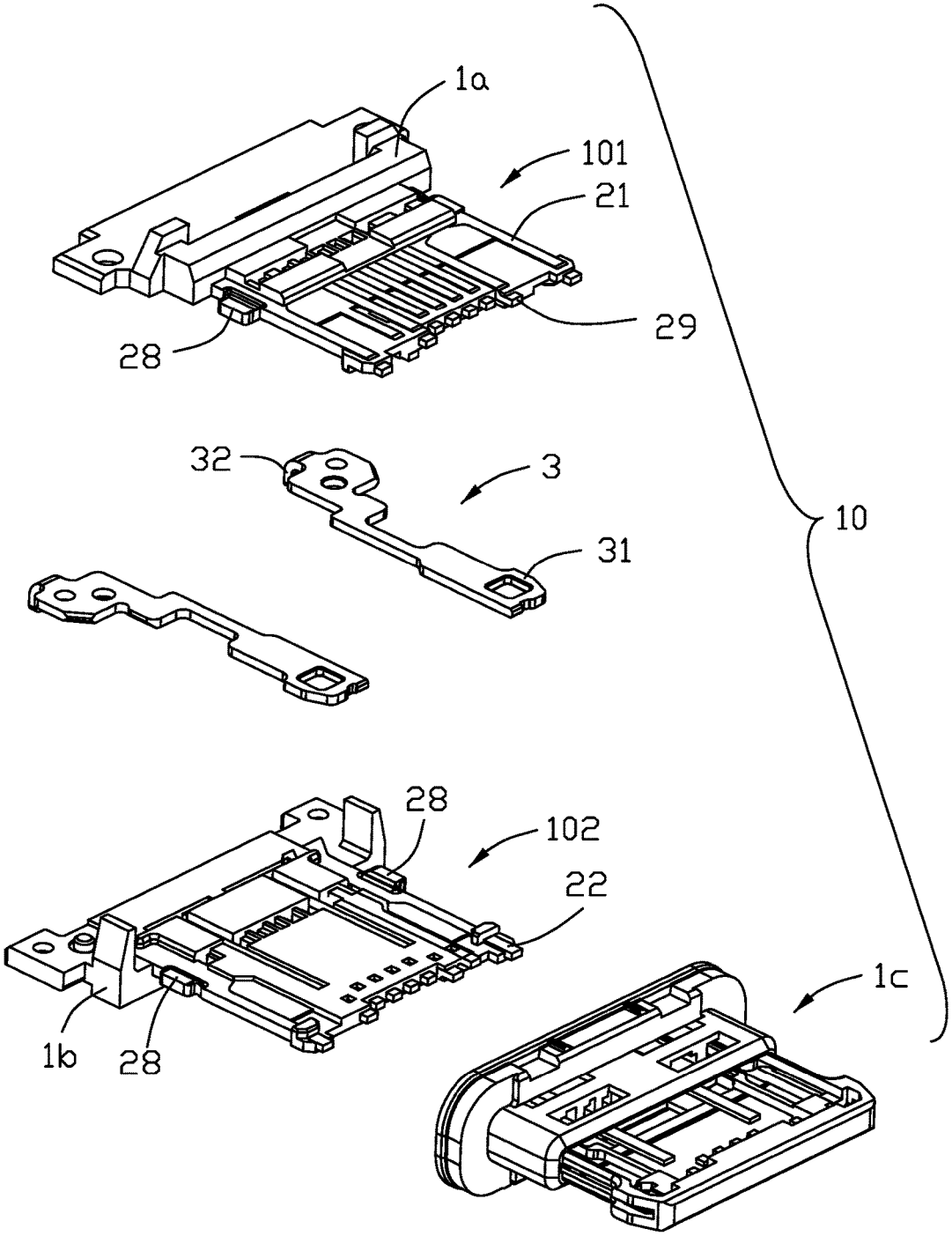
FIG. 4 is an exploded perspective view of the contact module of the electrical connector of FIG. 1.
Figure 5:
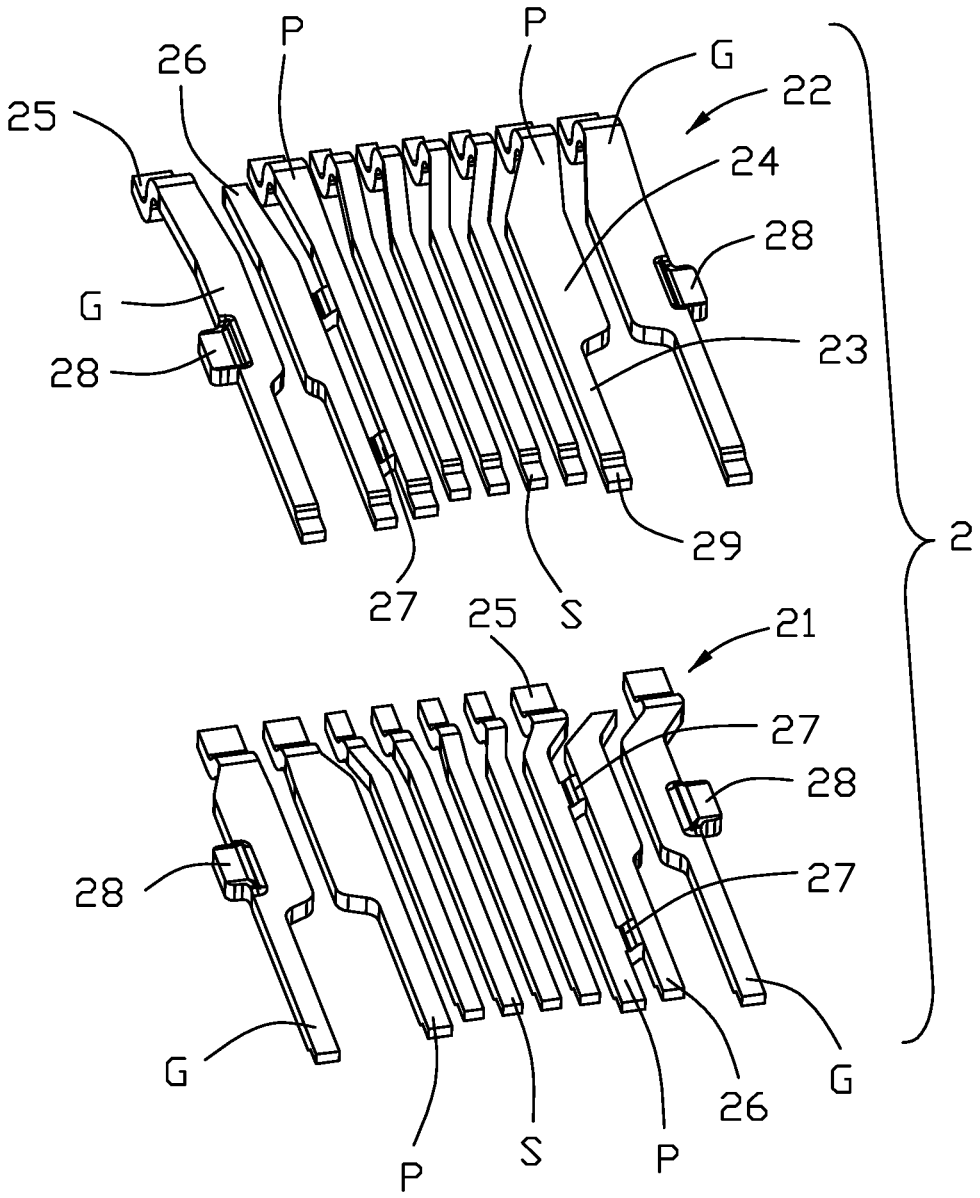
FIG. 5 is perspective view of the first contacts and the second contacts of the contact module of the electrical connector of FIG. 4.
Figure 6:
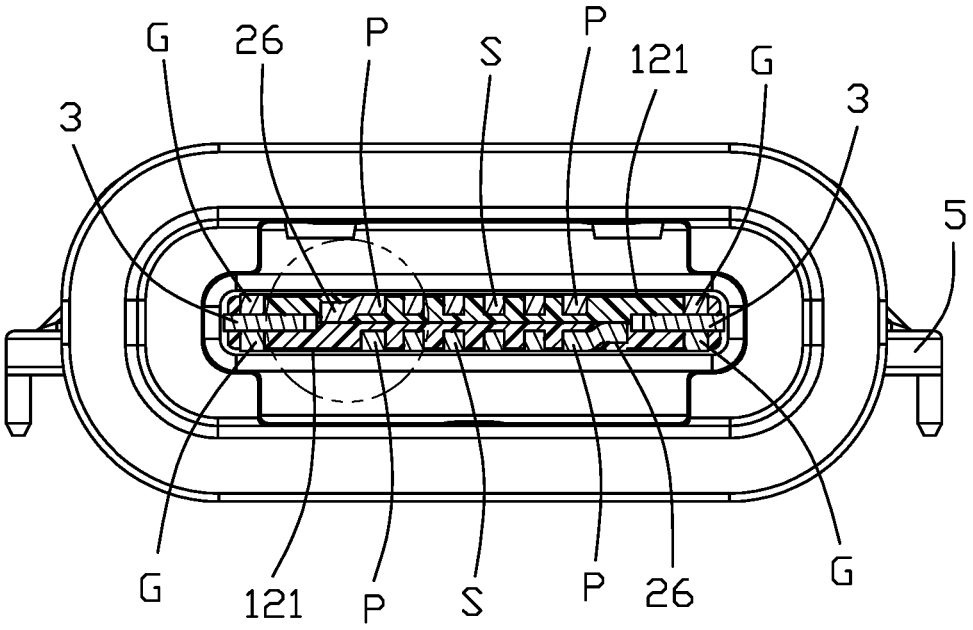
FIG. 6 is a cross-sectional view of the electrical connector of FIG. 1.
Figure 7:
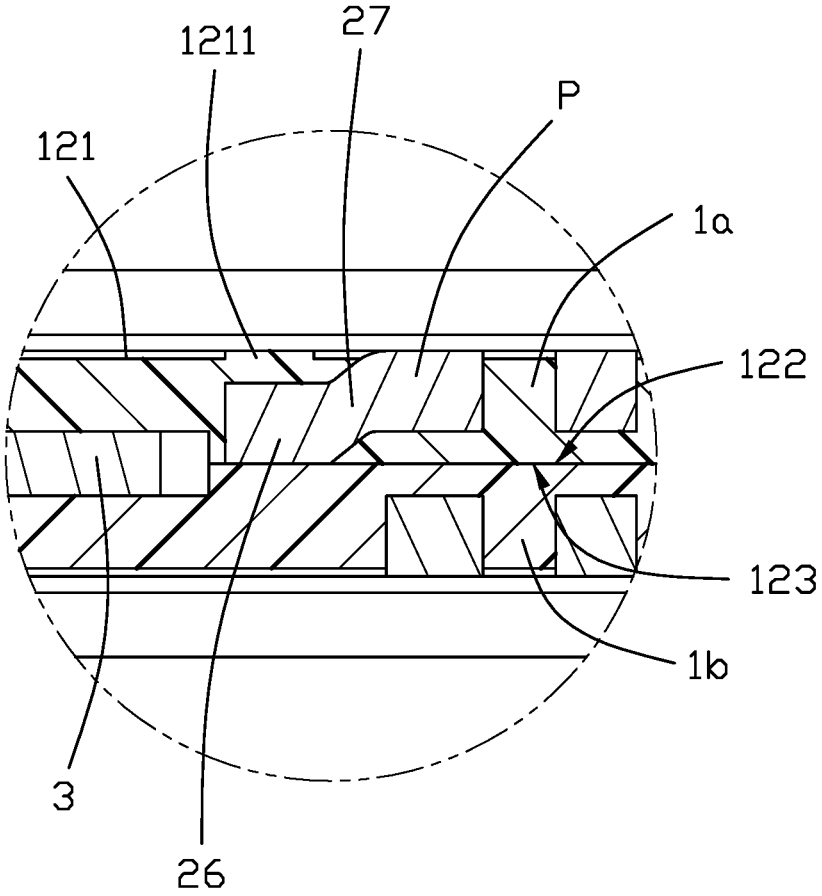
FIG. 7 is an enlarged cross-sectional view of a portion of electrical connector of FIG. 6.

Reference will now be made in detail to the embodiments of the present disclosure. Referring to FIGS. 1-7, an electrical card connector 100 includes a contact module 10 enclosed within a metallic inner shell 5. A waterproof part 4 attached to a rear side of the contact module 10 in the shell 5, and an metallic outer shell 6 surrounding the inner shell 5. The contact module 10 includes an insulative housing 1, two rows of contacts 2, including the first contacts 21 and the second contacts 22, disposed in the housing 1, and a pair of metallic plates 3 between two rows of contacts 2.

The insulative housing 1 includes a base 11 and a tongue portion 12 forwardly extending from the base in a front-to-back direction. The tongue portion 12 forms opposite mating surfaces 121. The housing 1 is formed by a first body 1*a*, a second body 1*b* and an insulator 1*c*. The first body 1*a* and the first contacts 21 commonly form the first contact module 101 via an insert-molding process, the second body 1*b* and the second contacts 22 commonly form a second contact module 102.

The first contacts 21 as well as the second contacts include the ground contacts G, the power contacts P on an inner side of the corresponding ground contact G, and the signal contacts S. The contact has the contacting section 23 exposed upon the mating surface 121, the mounting section 25 exposed outside of the housing 1, and the retaining section 24 between the mating section 25 and the contacting section 23, and an embedded section 29 in front of the contacting section 23 and within the tongue portion 12. A conductive bar 26 is located beside and parallel to the corresponding power contact P, and is embedded within the tongue portion 12 without being exposed upon the mating surface 121. The power contact P is electrically connected to the conductive bar 26 via a linking bar 27. The conductive bar 26 is to help heat dissipation derived from the power contact P. Understandably, the unexposed conductive bar 26 may avoid shorting with the contacts of the complementary plug connector.

In this embodiment, the power contact P, the conductive bar 26 and the linking bar 27 are unified together as one piece and forms a Z-shaped cross-section thereof. For stabilization consideration, there are two linking bars 27 between the power contact P and the conductive bar 26.

Understandably, because the material of the tongue portion 12, which covers the conductive bar 26, is less than other portions of the tongue portion 12, a standoff 1211 is formed upon or beyond the mating surface 121 in alignment with the conductive bar 26 in the vertical direction for preventing deficient molding due to the tiny distance between the mating surface 121 and the conductive bar 26.

The connector 100 includes a pair of metallic plates 3 in the tongue potion 12 which includes two locking edges 31 exposed upon two opposite lateral sides of the tongue portion 12. Each metallic plate 3 is located and further sandwiched between the ground G of the first contacts 21 and the ground G of the second contacts 22. The metallic plate 3 has the mounting leg 32. In this embodiment, the conductive bar 26 is partially overlapped with the metallic plate 3 in the transverse direction. Anyhow, the conductive bar 26 is not beyond the mid-level of the tongue portion 12 for complying with the surfaces of the first contact module 101 and the second contact module 102. Notably, instead of a complete full metallic plate, the space between the pair of metallic plates 3 may allow the conductive bar 26 to be located, thus facilitating implementing the invention. The grounds G have respectively the ears 28 soldered with each other for securing the first contact module 101 and the second contact module 102 with the metallic plates 3 therebetween together as a sub-assembly. Such a sub-assembly is successively overcooled with the insulator 1*c* to form the complete contact module 10.

The inner shell 5 includes a main body 51 forming a mating cavity 52, the supporting section 53 on two sides and the stopping section 54 inside the mating cavity 52. The contact module 10 is assembled within the mating cavity 52 with the base 11 forwardly abutting against the stopping section 54. The waterproof part 4 is attached upon a rear face of the base 11 of the contact module 10 in the inner shell 5. The outer shell 6 includes a top section 61 attached upon the inner shell 5, and the soldering leg 62 for mounting on the printed circuit board (not shown).

Notably, the first body 1*a* forms a first inner surface 122, and the second body 1*b* forms a second inner surface 123 abutting against the first inner surface 122 of the first body 1*a*. An inward surface (not labeled) of the conductive bar 26 of the first contact module 101 is flush with the first inner surface 122 of the first body 1*a* and abuts against the second inner surface 123 of the second body 1*b*, and an inward surface (not labeled) of the conductive bar 26 of the second contact module 102 is flush with the second inner surface 123 of the second body 1*b* and abuts against the first inner surface 122 of the first body 1*a*. Differently, the metallic plate 3 crosses the inner surface 122 of the first body 1*a* and the inner surface 123 of the second body 123 in its thickness direction so as to have the metallic plate 3 sandwiched between the first body 1*a* and the second body 1*b*.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module including:

an insulative housing including a base, and a mating tongue forwardly extending from the base in a front-to-back direction and defining opposite first and second mating surfaces thereon in a vertical direction perpendicular to the front-to-back direction;

a plurality of contacts including first contacts located in the housing at an upper level and arrange with one another in a transverse direction perpendicular to both the front-to-back direction and the vertical direction, and second contacts located in the housing at a lower level and arranged with one another along the transverse direction, both said first contacts and second contacts including power contacts, ground contacts and signal contacts, each of said first contacts and said second contacts including a front contacting section exposed upon the corresponding mating surface, a rear mounting section exposed outside of the housing, and a retaining section therebetween in the front-to-back direction, a space formed between the neighboring power contact and ground contact in said transverse direction and dimensioned to receive two additional contacts therein; and a conductive bar located in the space and electrically connected to the power contact in a hidden manner without exposure upon the corresponding mating surface, wherein said conductive bar extends in said front-to-back direction, wherein said conductive bar is connected to the power contact via a linking bar, wherein the linking bar extends in the transverse direction, wherein said linking bar extends in an offset manner in the vertical direction; wherein said conductive bar extends in said front-to-back direction; wherein said conductive bar is connected to the power contact via a linking bar; wherein the linking bar extends in the transverse direction; wherein said linking bar extends in an offset manner in the vertical direction.

2. The electrical connector as claimed in claim 1, further including a pair of metallic plates between the ground contact of the first contacts and the ground contact of the second contacts, wherein the pair of metallic plates forms a space therebetween in the transverse direction to receive the conductive bar therein without interference.

3. The electrical connector as claimed in claim 1, wherein the ground contact of the first contacts and the ground contacts of the second contacts have ears stacked and soldered with each other in the vertical direction.

4. The electrical connector as claimed in claim 3, wherein the first contact module and the second contact module are secured to each other with a pair of metallic plates sandwiched therebetween in the vertical direction by soldering said ears together.

5. An electrical connector comprising:

a contact module including:

an insulative housing including a base, and a mating tongue forwardly extending from the base in a front-to-back direction and defining opposite first and second mating surfaces thereon in a vertical direction perpendicular to the front-to-back direction;

a plurality of contacts including first contacts located in the housing at an upper level and arrange with one another in a transverse direction perpendicular to both the front-to-back direction and the vertical direction, and second contacts located in the housing at a lower level and arranged with one another along the transverse direction, both said first contacts and second contacts including power contacts, ground contacts and signal contacts, each of said first contacts and said second contacts including a front contacting section exposed upon the corresponding mating surface, a rear mounting section exposed outside of the housing, and a retaining section therebetween in the front-to-back direction, a space formed between the neighboring power contact and ground contact in said transverse direction and dimensioned to receive two additional contacts therein; and a conductive bar located in the space and electrically connected to the power contact in a hidden manner without exposure upon the corresponding mating surface; wherein the housing includes a first body integrally formed with the first contacts and forming a first inner surface, and a second body integrally formed with the second contacts and forming a second inner surface abutting against the first inner surface of the first body; wherein an inward surface of said conductive bar is flush with said first inner surface of the first body and abuts against said second inner surface of the second body.

6. The electrical connector as claimed in claim 5, further including a metallic plate sandwiched between the first body and the second body, wherein said metallic plate crosses both said first inner surface of the first body and said second inner surface of the second body in a thickness direction of said metallic plate.

* * * * *